US006047936A

United States Patent [19]

Favotto et al.

[11] Patent Number: 6,047,936

[45] Date of Patent: Apr. 11, 2000

[54] FIXING BRACKET, PARTICULARLY FOR TRANSFORMERS

[75] Inventors: Virginio Favotto, Treviso; Fausto Martin, Oderzo, both of Italy

[73] Assignee: Siet Societa' Italiana Elettronica Trasformatori SRL, Silea, Italy

[21] Appl. No.: 09/035,352

[22] Filed: Mar. 5, 1998

[30] Foreign Application Priority Data

Nov. 7, 1997 [IT] Italy ..... TV970057 U

[51] Int. Cl.[7] ..... A47F 5/16; H01F 27/06

[52] U.S. Cl. ..... 248/309.1; 248/674; 336/92

[58] Field of Search ..... 248/674, 644, 248/220.21, 220.22, 222.11, 73, 243, 309.1; 361/836; 336/92

[56] References Cited

U.S. PATENT DOCUMENTS 3,050,703 8/1962 Duescher ..... 336/67
4,313,043 1/1982 White et al. ..... 248/674
5,337,034 8/1994 Grimes ..... 336/92
5,478,036 12/1995 Wu ..... 248/220.22
5,588,621 12/1996 Collins, Jr. et al. ..... 248/220.22
5,789,828 8/1998 Tremaine et al. ..... 361/836

*Primary Examiner*—Anita M. King
*Attorney, Agent, or Firm*—Guido Modiano; Albert Josif

[57] ABSTRACT

A fixing bracket for fixing to a support a box-like structure which contains electrical components, such as a transformer, and has an external electrical wiring region, the bracket comprising a base with fastening elements for fastening the base to the support, an elastic coupling element for quick coupling of the box-like structure to the base, a box-like extension protruding from the base and which is partially open for receiving the wiring region, a sealing gasket arranged at the partially open portion of the box-like extension for sealing association with the box-like structure, and a condensate drain.

20 Claims, 5 Drawing Sheets

FIXING BRACKET, PARTICULARLY FOR TRANSFORMERS

BACKGROUND OF THE INVENTION

The present invention relates to a fixing bracket particularly for transformers.

Currently it is known to manufacture transformers for neon lights which are used particularly outdoors, for example outside a house; these transformers are usually constituted by a metallic container inside which electrical components are accommodated which must be wired to suitable devices.

A drawback observed in these conventional transformers is the fact that they are subjected to malfunctions caused by possible infiltrations of water or moisture inside them, due to the fact that the transformers are located outdoors.

In particular, the connections of the cables or of the electrical conductors are penalized; moreover, some statutory provisions prescribe that the insulating sheath of the electrical cable must not be wet by rain and must not cause stagnation inside the transformer.

Covering and containment boxes for transformers are thus conventionally used. This solution, however, is not ideal, since it entails a considerable bulk and requires the provision of two compartments: one for the transformer and one for the cable coupling sleeves.

Moreover, these boxes are more difficult to position, indeed because they are bulky and can in any case be a condensation site for air moisture and a hindrance to the dissipation of the heat produced by the transformer.

Additionally, both the insertion of the transformer in the box and its wiring are not easy, since various tools are required and there is a large number of screws to be tightened.

Moreover, there is often a lack of anchoring points for the transformer, which produces unpleasant vibrations and causes humming during operation.

Boxes without the double compartment are also conventionally used; also this solution, however, is bulky and therefore difficult to position due to its large volume and is also affected by the same drawbacks mentioned above.

SUMMARY OF THE INVENTION

The aim of the present invention is to solve the above-mentioned problems, eliminating the drawbacks of the cited prior art and thus by providing a fixing bracket which allows outdoor placement of transformers, particularly for neon lights, protecting said transformers against possible malfunctions due to the stagnation of water at the sheath of the electrical cables in the region for wiring to the transformer.

Within the scope of this aim, an important object of the present invention is to provide a fixing bracket which allows easy and quick installation of an outdoor neon light transformer.

Another important object of the present invention is to provide a fixing bracket which allows to achieve easy pre-wiring and placement of the transformer.

Another important object of the present invention is to provide a fixing bracket having a simple and compact structure.

Another important object of the present invention is to provide a fixing bracket in which the insulating sheath of the electrical cable is not wet by rain in the region for wiring to the transformer.

Another object of the present invention is to provide a fixing bracket having a low weight and allowing to stably connect both rigid and flexible tubes for the wiring of the transformer.

Another object of the present invention is to provide a fixing bracket which associates with the preceding characteristics that of having low manufacturing costs and of being obtainable with conventional machines and equipment.

This aim, these objects and others which will become apparent hereinafter are achieved by a fixing bracket, particularly for transformers, characterized in that it comprises a base provided with means for fastening to a wall or to fixed supports and elastic coupling means for a transformer, a box-like extension protruding from said base, said extension having watertight sealing means and condensation draining means which form a protected region at wiring points of the transformer.

BRIEF DESCRIPTION OF THE DRAWINGS

Further characteristics and advantages of the fixing bracket according to the present invention will become apparent from the following detailed description of a particular but not exclusive embodiment thereof, illustrated only by way of non-limitative example in the accompanying drawings, wherein.

DISCLOSURE OF THE PREFERRED EMBODIMENTS

Figure 1:
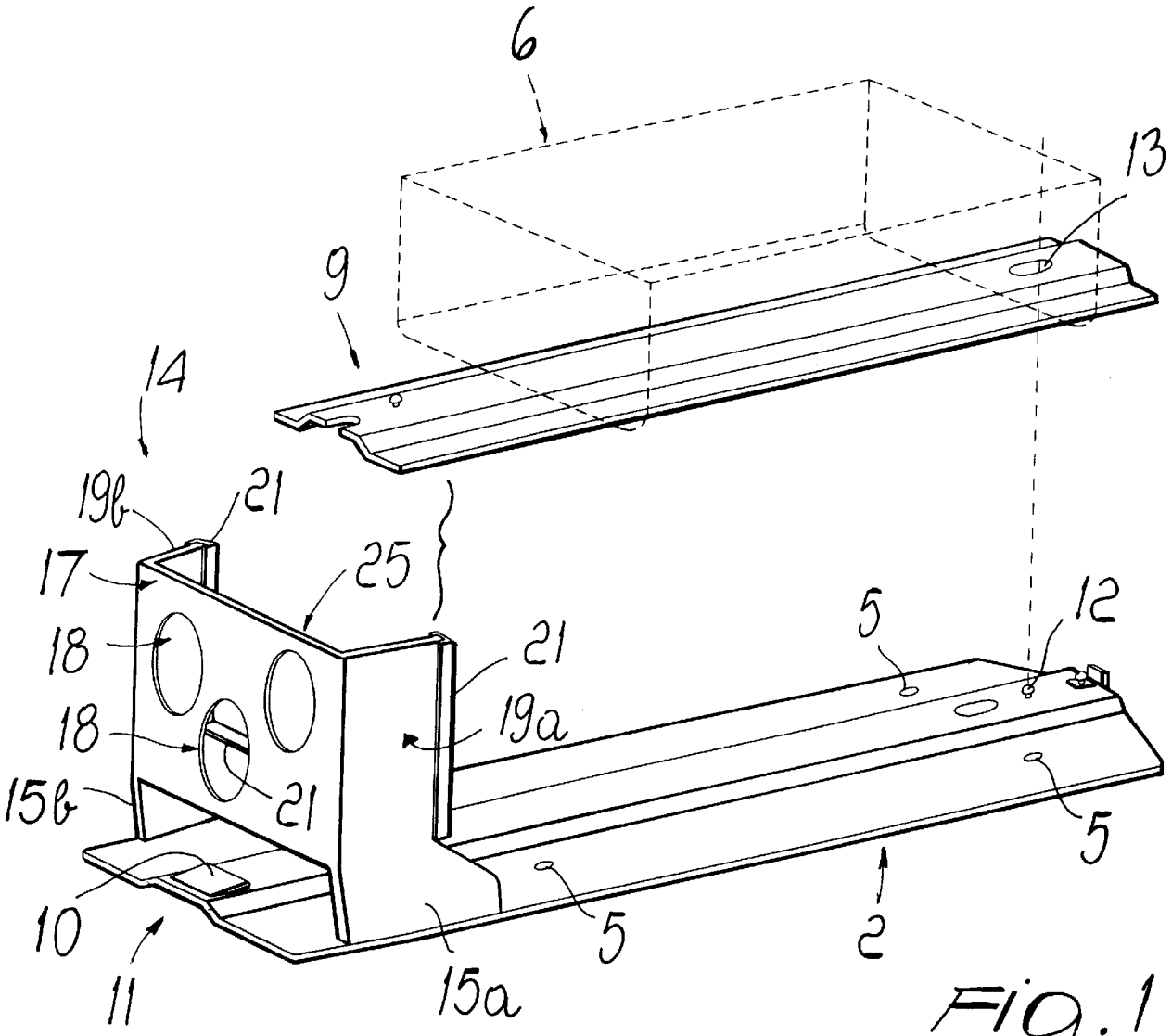
FIG. 1 is a side perspective view of a bracket according to the present invention to which a transformer is to be applied.
Figure 2:
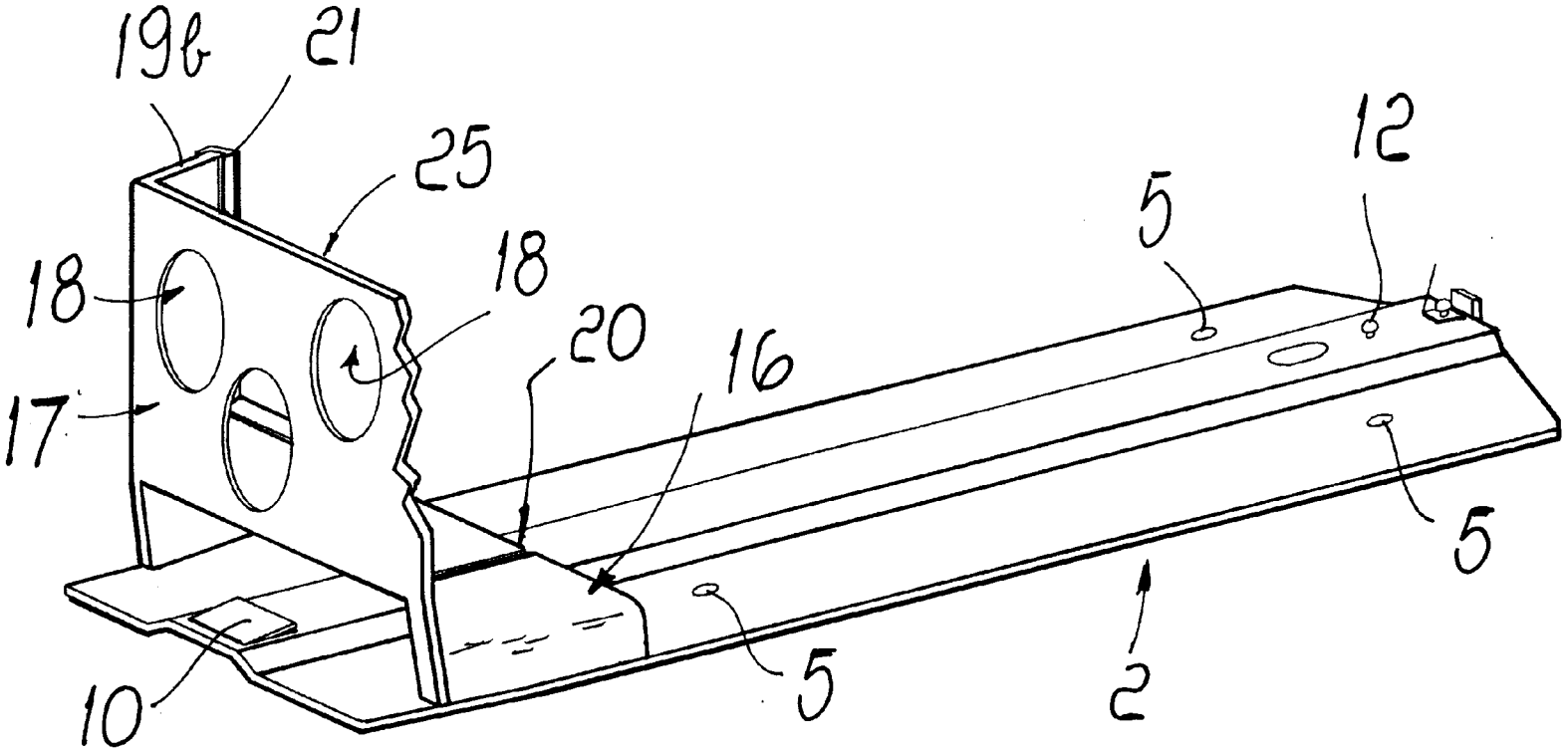
FIG. 2 is a partially sectional view, similar to FIG. 1, of the bracket.
Figure 3:
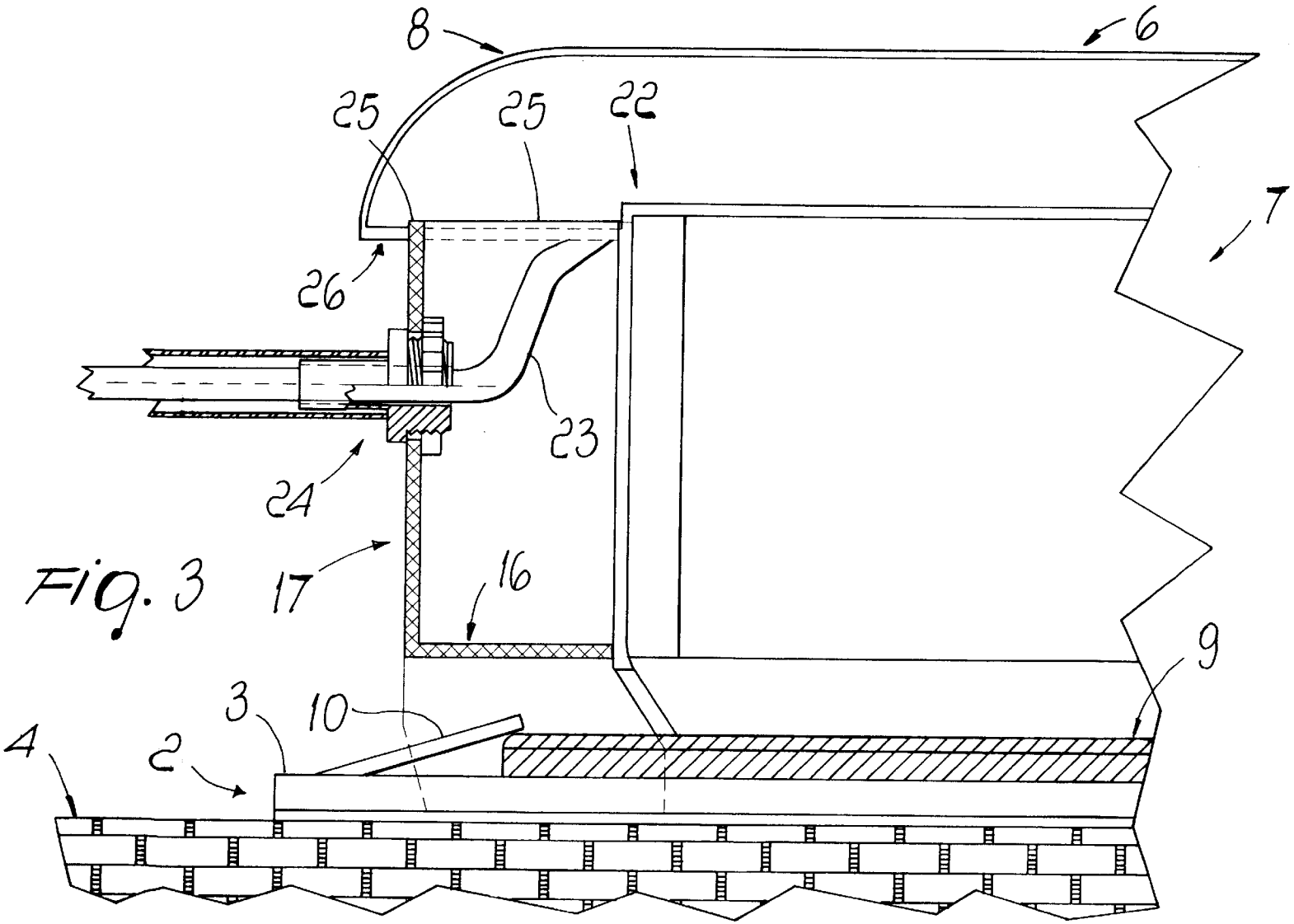
FIG. 3 is a partially sectional side view of a transformer which is associated with the bracket and is wired.
Figure 4:
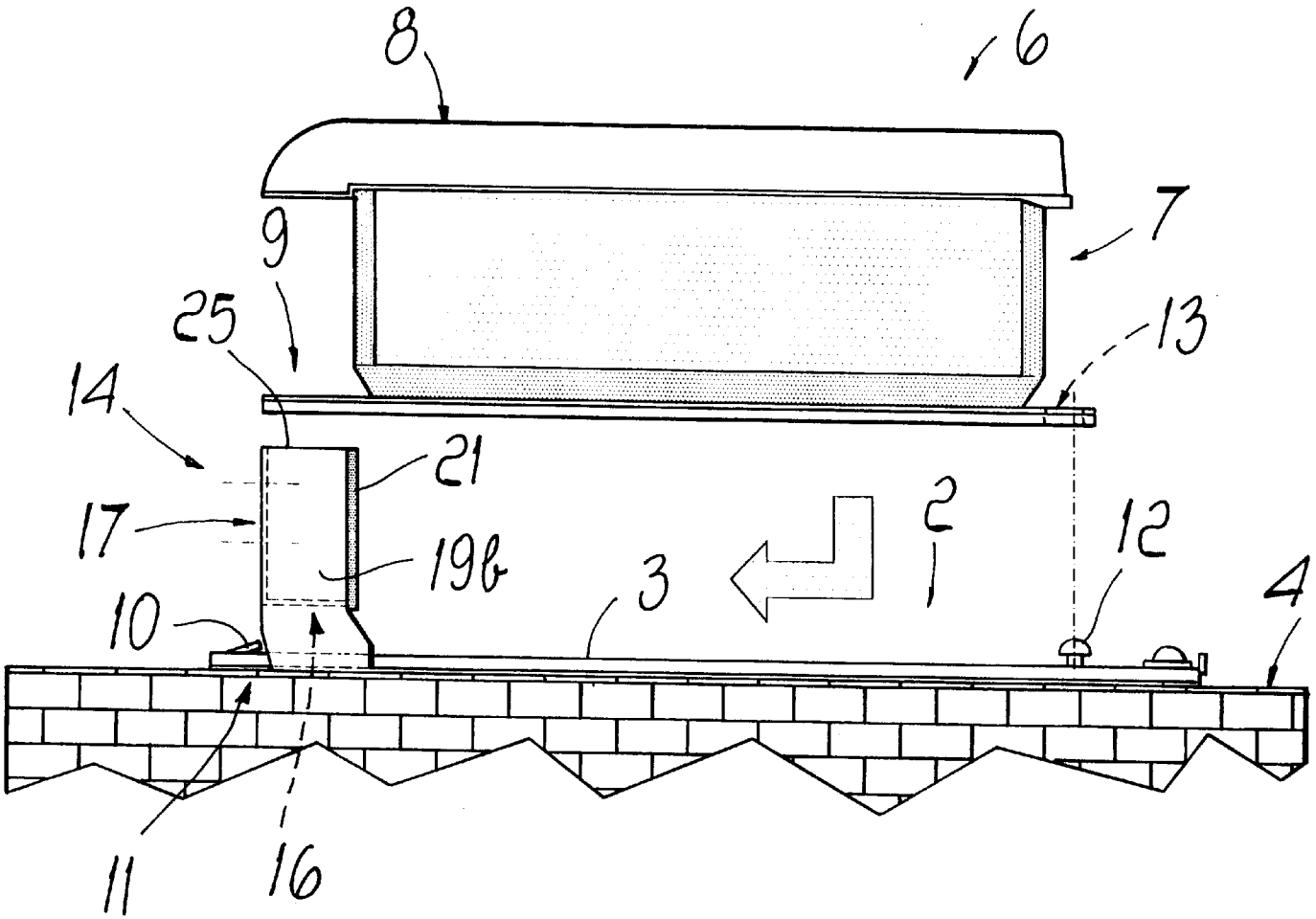
FIGS. 4 and 5 are side views of the connection of the transformer to the bracket.

With reference to the above figures, a bracket is provided having a base 2 which is shaped, in transverse cross-section, like the lowercase letter n, so as to thus form a raised longitudinal plane 3.

At the base 2 means are provided for fastening to a wall 4 or to a fixed support; said means are constituted by suitable first holes 5 for screws or other equivalent means.

At the raised longitudinal plane 3, instead, elastic coupling means are provided for a transformer 6, which is substantially constituted by a box-like structure 7 closed by a cover 8 and associated, in a downward region, with a bar 9 which is also shaped like a lowercase letter n.

The elastic coupling means are constituted by a tab 10 that protrudes above the raised longitudinal plane 3 proximate to a first end 11, which is also termed first lower end.

The corresponding tip of the bar 9 can be inserted at the tab 10.

The bar 9 is fastened to the base 2 by virtue of the presence, at the raised longitudinal plane 3, of a screw 12 which protrudes at the opposite end with respect to the tab 10 and can be positioned at a suitable slot 13 formed on said bar 9.

A box-like extension 14 protrudes from the base 2, at the first end 11, is as wide as the base 2 and is connected thereto by means of two lateral wings 15*a* and 15*b*.

The box-like extension 14 thus has a first bottom wall 16 which transversely connects lateral wings 15*a* and 15*b* and is arranged on a plane which is approximately parallel to the plane of the underlying base 2.

The first bottom wall 16 is connected, on the side directed towards the tab 10, by a second rear wall 17 which is as wide as the base 2 and on which one or more second holes 18 are formed.

The first bottom wall 16 and the second rear wall 17 are also connected to third side walls 19*a*, 19*b*, which are as high as the second rear wall 17 and as deep as the first bottom wall 16.

A slot 20 for draining any condensation is further formed at said first bottom wall, along an axis that lies longitudinally to the base 2.

Watertight sealing means, constituted by a gasket 21, are associated at the sides of the first bottom wall 16 and of the third side walls 19*a*, 19*b* which are directed away from the tab 10.

The box-like extension 14 and the presence of the gasket 21 form a protected region for the transformer 6 and in particular for its end 22 which is adjacent to, and lies above, the tab 10 whereat suitable cables 23 are wired. The cables are inserted in the box-like extension 14 through the second holes 18 by using suitable cable coupling sleeves 24.

The dimensions of the box-like extension 14 are such that it surrounds, on three sides, the end 22 of the transformer 6, whose cover 8 has such dimensions as to also protect the underlying upper perimetric edge 25 of the second rear wall 17 and of the third side walls 19*a* and 19*b*.

Figure 5:
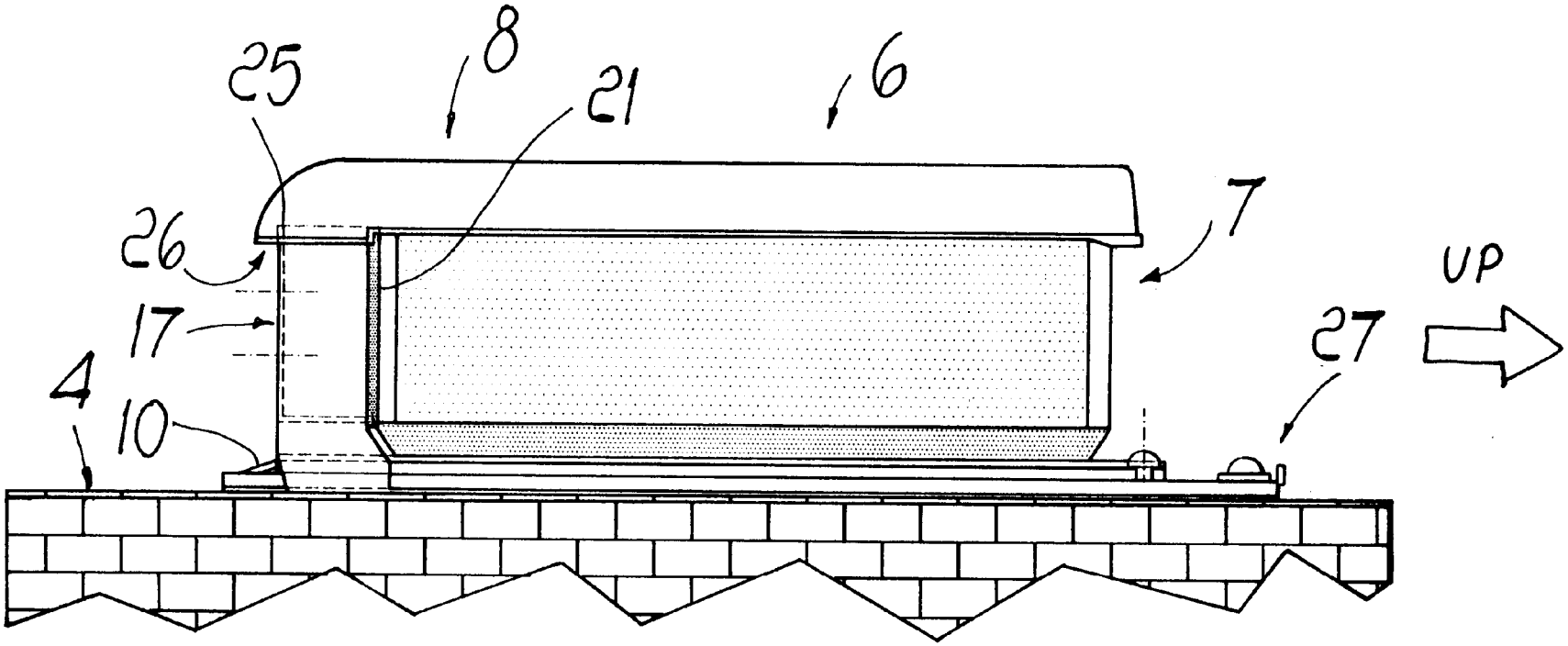

The mutual assembly of the bracket 1 and of the transformer is shown in FIG. 5.

It is therefore easy to pre-wire the transformer and, once the transformer has been associated with the base 2, to keep said wiring region in an area which is protected from the effects of weather, since the cables are contained thereat within the box-like extension 14 and are protected against water infiltrations by the gasket 21 and the cover 8.

Any condensation that might form due to the operating temperature of the transformer is drained, assuming that the transformer is always installed vertically, through the slot 20.

A slit 26 is further provided between the cover 8 and the upper perimetric edge 25 of the second rear wall 17 and of the third side walls 19*a* and 19*b* of the box-like extension 14 and allows further elimination of moisture due to condensation.

The provision of the base 2 using metal also allows to form a flame-retardant barrier if the underlying wall 4 is made of flammable material, thus allowing to install the transformer in compliance with any accident-prevention prescriptions.

The n-shaped configuration of the base 2 also keeps the transformer raised from the surface, further improving convective heat dissipation and removing it from the accumulation of rainwater.

Moreover, the coupling of the transformer to the bracket is very simple and easy, since it is necessary to use a simple screwdriver to tighten the screw 12.

It is also possible to provide an earth terminal 27 so that the bracket and the transformer become bonded.

It has thus been observed that the invention has achieved the intended aim and objects, a bracket having been provided which allows easy and quick outdoor positioning and installation of transformers, particularly for neon lights, protecting them from any malfunction due to stagnation of water at the sheath of the electrical cables in the region for wiring to the transformer.

The bracket according to the invention also has a simple and compact structure, the transformer being quickly associable therewith and compensating for any vibrations, so as to eliminate any humming.

The bracket thus allows to prevent the insulating sheath of the electrical cable from being wet by the rain in the transformer wiring region and also allows to stably apply thereto both rigid and flexible tubes for the wiring of the transformer.

The omega-like shape of the bracket allows to dissipate the heat generated by the transformer.

The invention is of course susceptible of numerous modifications and variations, all of which are within the scope of the same inventive concept.

The materials and the dimensions that constitute the individual components of the structure may of course be the most pertinent according to specific requirements.

What is claimed is:

1. A fixing bracket for fixing to a support a box-like structure containing electrical components and including an external electrical wiring region, the bracket comprising:

a base;

fastening means provided at said base for fastening the base to said support;

elastic coupling means for quick coupling of the box-like structure to the base, said coupling means comprising at least one elastic coupling element for compensating operation vibrations;

a box-like extension protruding from said base, said box-like extension being partially open at a portion thereof for receiving said wiring region;

watertight sealing means arranged at said partially open portion for providing sealing association of the box-like structure with said box-like extension, upon coupling of the box-like structure to said base, and for providing a weatherproof area for the wiring region; and condensate draining means for draining condensate formed at said weatherproof area.

2. The fixing bracket of claim 1, wherein said base has a cross-sectional omega-shape and extends longitudinally between a first end and a second end thereof so as to form a raised longitudinal plane.

3. The fixing bracket of claim 2, wherein said elastic coupling means are constituted by at least one tab that protrudes upward with respect to said raised longitudinal plane proximate to said first end of said base.

4. The fixing bracket of claim 3, further comprising a screw that protrudes from said base at said second end thereof, said screw allowing connection of said box-like structure to said base.

5. The fixing bracket according to claim 2, wherein said box-like extension protrudes from said base, at said first end thereof, is as wide as said base and is connected to said base by way of two lateral wings.

6. The fixing bracket of claim 5, wherein said box-like extension has a first bottom wall which transversely connects said lateral wings and is arranged on a plane which is substantially parallel to said base.

7. The fixing bracket of claim 6, comprising a second rear wall which is as wide as said base, and at least one wire passage hole formed at said rear wall, said first bottom wall being connected, at an end thereof directed toward said at least one tab, to said rear wall.

8. The fixing bracket of claim 7, comprising two third side walls which are as high as said second rear wall and approximately as deep as said first bottom wall, said first bottom wall and said second rear wall being connected to said third side walls.

9. The fixing bracket of claim 8, wherein said condensate draining means comprises at least one slot arranged at said first bottom wall along an axis which lies longitudinally to said base.

10. The fixing bracket of claim 8, wherein said watertight sealing means is constituted by a gasket which is located at least at sides of said first bottom wall and third side walls directed away from said at least one tab.

11. The fixing bracket of claim 10, comprising at least one cable coupling sleeve provided at said at least one wire passage hole for allowing passage of wires of said electrical wiring region outside of said box-like extension.

12. The fixing bracket of claim 10, wherein said gasket surrounds said partially open portion on three sides.

13. In combination, a box-like structure including electrical components and having an electrical wiring region, and a fixing bracket for fixing to a support said box-like structure, wherein the bracket comprises:

a base;

fastening means provided at said base for fastening the base to said support;

elastic coupling means provided at said base for quick coupling of said box-like structure to the base, said coupling means comprising at least one elastic coupling element for compensating any operation vibration;

a box-like extension protruding from said base, said box-like like extension being open at a portion thereof for receiving said wiring region, said open portion being shaped so as to allow mating engagement of the box-like structures thereto;

watertight sealing means arranged at said open portion of the box-like extension for providing sealing engagement of said box-like structure at said open portion, upon coupling of the box-like structure to said base, and for providing a weatherproof area for the wiring region;

condensate draining means for draining any condensate formed due to atmospheric humidity and temperature conditions.

14. The combination of claim 13, wherein said fixing bracket base has a cross-sectional omega-shape and extends longitudinally between a first end and a second end thereof so as to form a raised longitudinal plane.

15. The combination of claim 14, wherein said elastic coupling means are constituted by at least one tab that protrudes upward with respect to said raised longitudinal plane proximate to said first end of said base.

16. The combination of claim 15, wherein said fixing bracket further comprises a screw that protrudes from said base at said second end thereof, said screw allowing connection of said box-like structure to said base.

17. The combination of claim 13, wherein the box-like structure comprises a cover arranged in an upward region thereof, and a bar shaped like a lower-case letter n associated in a downward region thereof.

18. The combination of claim 17, wherein, upon coupling of said box-like structure to said base, said cover overlaps an upper part of the open portion of said box-like extension.

19. A fixing bracket fixable to a support and a box-like structure coupleable to the bracket, the box-like structure enclosing an electrical transformer and having an external electrical wiring region, the bracket comprising:

a base forming an arrangement plane for said box-like structure;

fastening means provided at said base for fastening the base to said support;

elastic coupling means for quick coupling of the box-like structure to the base at said arrangement plane, said coupling means comprising at least one elastic coupling element providing coupling with compensation of operational vibrations;

a box-like extension protruding from said base, said box-like extension having an open portion for receiving said wiring region, said open portion being shaped for receiving in mating engagement the box-like structure with said wiring region accommodated inside the box-like extension;

watertight sealing means arranged at said partially open portion for providing sealing engagement of the box-like structure with said box-like extension, upon coupling of the box-like structure to said base, and for providing a weatherproof area for the wiring region;

further fastening means acting in cooperation with said elastic coupling means for fastening the box-like structure to said base; and condensate draining means for draining condensate formed at said weatherproof area.

20. The fixing bracket and box-like structure of claim 19; wherein said elastic coupling means are constituted by at least one tab that protrudes upward from said base at a first end thereof, and wherein said further fastening means comprise: a bar having a first end tip and a second opposite end provided with a slot, said bar being attached at a lower base of said box-like structure; and a screw that protrudes from said bracket base at a second end thereof opposite to said first end, the end tip of said bar being detachably inserted at said at least one tab and the second bar end being connected to the base by way of said screw protruding through said slot.

* * * * *